United States Patent [19]

Brown et al.

[11] 4,342,476

[45] Aug. 3, 1982

[54] ELECTROMECHANICAL LID LATCH ASSEMBLY

[75] Inventors: Wade R. Brown, St. Charles; James M. Pick, Carol Stream, both of Ill.

[73] Assignee: Eaton Corporation, Cleveland, Ohio

[21] Appl. No.: 171,774

[22] Filed: Jul. 24, 1980

[51] Int. Cl.[3] ..... E05C 3/12

[52] U.S. Cl. ..... 292/201; 292/DIG. 69; 292/64

[58] Field of Search ..... 292/DIG. 69, 201, 144, 292/64

[56] References Cited

U.S. PATENT DOCUMENTS

| | | | |
|---|---|---|---|
| 2,618,282 | 11/1952 | Slanitz et al. | 292/DIG. 69 |
| 3,848,907 | 11/1974 | Shiurela | 292/201 X |
| 4,074,545 | 2/1978 | Case | 292/DIG. 69 |
| 4,179,907 | 12/1979 | Schantz | 292/DIG. 69 |

*Primary Examiner*—Richard E. Moore

*Attorney, Agent, or Firm*—C. H. Grace; A. Johnston

[57] ABSTRACT

A lid latch assembly (10) for a household washing machine is disclosed which incorporates safety features which prevent damage to the latch assembly regardless of when the drum access lid of the machine is closed. The assembly includes a solenoid (22) operated locking lever (60) pivotally mounted to a bracket (12). An elongated slot (68) in the bracket defines a first fulcrum (66) about which the locking lever pivots during latching movement. A switch arm (30) must be depressed downwardly by a latching hook (84) connected to the machine lid (80) before the locking lever is movable to the latched position. A blocking tab (58) on the switch arm prevents movement of the lever to the latched position prior to downward movement of the switch arm. The elongated slot allows the locking lever to pivot about a second fulcrum defined by the blocking tab.

10 Claims, 5 Drawing Figures

Fig. 2
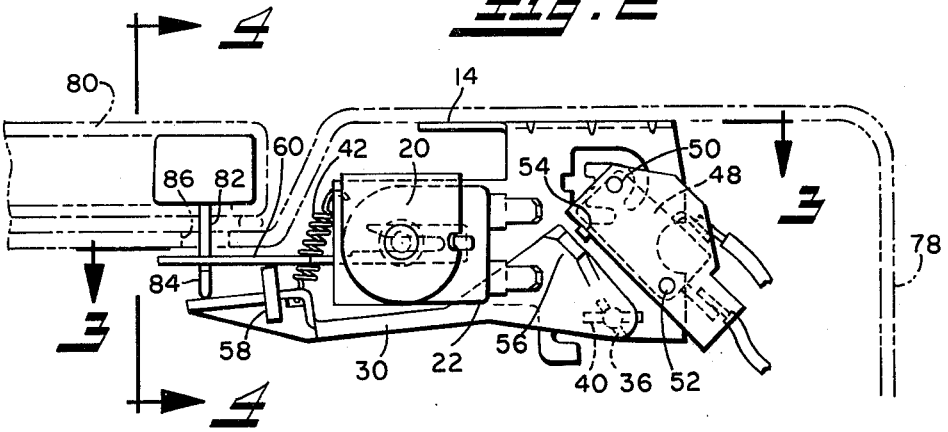
Fig. 3
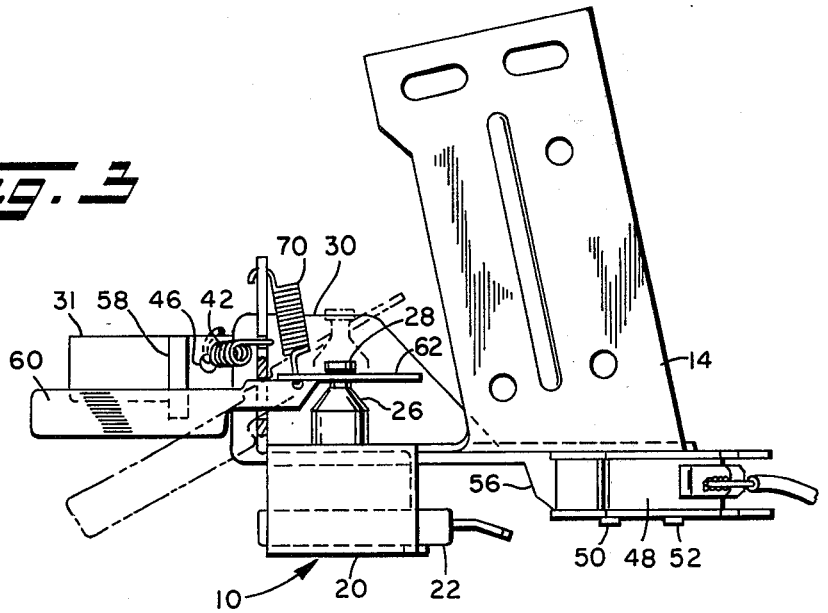
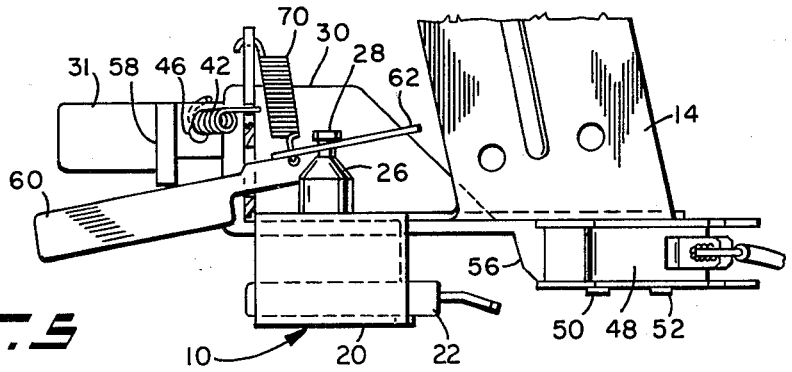
Fig. 5

ELECTROMECHANICAL LID LATCH ASSEMBLY

BACKGROUND OF INVENTION

This invention relates to electromechanical lid latches for use in household appliances and particularly household washing machines. In particular the invention relates to machines of the type having a washing cycle in which the clothes drum is rotated at a relatively slow rate and a spin cycle in which the clothes drum is rotated at a substantially faster rate. In machines of this type, it is known to provide an automatic lid latch lock to prevent opening of the drum access door as lid during the spin cycle.

DESCRIPTION OF PRIOR ART

A known electromechanical lid latch incorporates a pivotally mounted locking lever operated by movable armature of electrical solenoid. When the solenoid is energized, the locking lever is moved to a position in which its locking end is moved over a hook mounted on the appliance lid, thereby preventing upward movement of the lock and opening of the lid.

The solenoid actuated locking lever is energized by the washing machine timer during the spin cycle to prevent opening of the lid during the high speed spin cycle, thus functioning as a safety feature.

A problem has arisen where the operator leaves the washing machine lid open and the spin cycle on the timer has started and then subsequently closes the lid. The lid hook bends the locking lever downwardly sufficient to actuate the switch lever so that the washing machine drum begins spinning. The lid could then be opened during the spin cycle since the locking lever would have been damaged.

A need has thus arisen for an electromechanical lid latch that can not be damaged by the operator where the spin cycle is started with the lid initially open and the lid is closed during the spin cycle. Furthermore, such a latch mechanism must also have the capacity to lock when closed after the spin cycle has started.

SUMMARY OF INVENTION

In the present invention an electromechanical lid latch is provided having a switch lever with a blocking tab located thereon adjacent the contact point of the lid latch hook. A pivotally mounted, spring biased locking lever is connected at one end to an armature of a solenoid and movable between an open position spaced from the switch lever and a closed position generally aligned with the switch lever when the switch lever is depressed downwardly by the lid latch hook.

A unique feature of the locking lever mounting is a movable fulcrum arrangement defined by surfaces of an elongated slot through which the lever extends. During normal operation of the lid latch, the spring bias holds the lever against one surface of the slot, thereby allowing the lever to assume the predetermined locking position when the solenoid is energized. If the operator fails to close the lid and the spin cycle is reached by the timer, the solenoid will be energized pulling the armature inwardly with a force sufficient to overcome the force which is exerted on the locking lever by the biasing spring.

BRIEF DESCRIPTION OF THE DRAWINGS

FIG. 2 is a view of the lid latch of FIG. 1 taken from the right side (solenoid side of FIG. 1) shown in the locked position in association with a lid and frame structure of a washing machine;

FIG. 3 is a top view of the lid latch shown with the solenoid actuated and the locking lever aligned in the locked position over the lid hook with the dashed lines showing the locking lever in the unlocked position and the solenoid armature in a de-energized position;

FIG. 5 is a top view similar to FIG. 3 showing the locking lever held in an unlocked position by the switch arm while the solenoid is energized.

DETAILED DESCRIPTION

Figure 1:
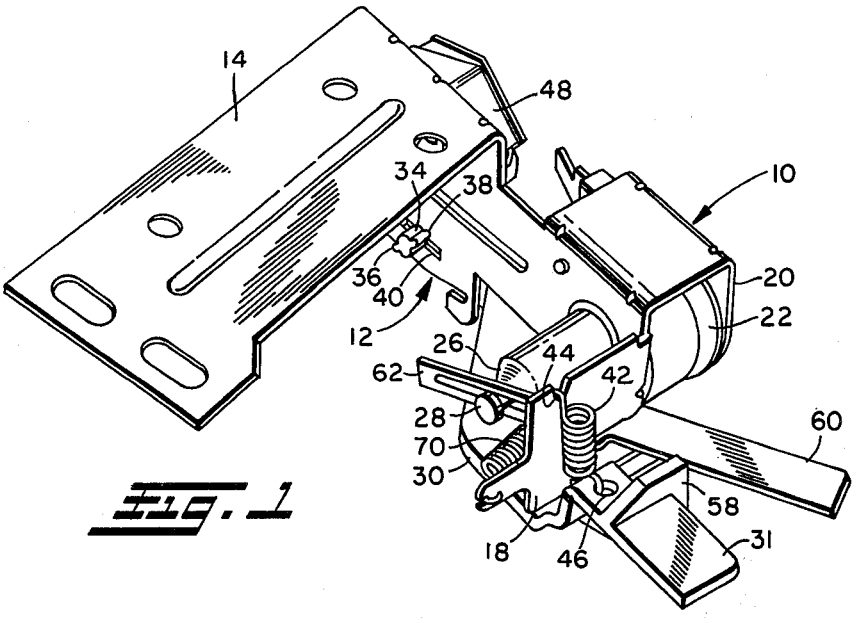
FIG. 1 is a view in perspective of an electromechanical lid latch embodying the principles of the invention.

Referring now to FIG. 1, there is indicated generally by reference numeral 10 an electromechanical lid latch embodying the principles of the invention. Latch 10 includes a bracket indicated generally by reference numeral 12, having a horizontal mounting arm portion 14, a vertical portion 16 extending generally perpendicular to horizontal portion 14, a vertical end portion 18 formed at a right angle to portion 16, and a looped portion 20 which serves to mount an electrical solenoid, indicated generally at 22.

Solenoid 22 includes an armature 24 slidably received in a central bore through the solenoid winding and an opening in the bracket aligned therewith. The outer end of the armature has a conical end portion 26 which terminates in a flanged end portion 28.

A switch arm 30 is pivotally mounted at one end thereof to vertical portion 16 of the bracket and is movable in a vertical plane. Switch arm 30 includes a free end portion 31 and is connected to the bracket by a cylindrical projection 34 and aligned, radially extending key portions 36, 38 which extend through a similarly configured opening 40 in the bracket.

Key portions 36, 38 of the switch arm are angularly aligned relative to opening 40 such that the switch arm is retained to the bracket during normal pivotal movement. A biasing spring 42 has one end connected to a notch 44 formed in bracket end portion 18 and the other end received through an opening 46 in the switch arm.

As shown in FIGS. 1 and 2, a microswitch 48 is mounted to bracket vertical portion 16 by rivets 50, 52 and includes a switch button 54 which is actuated by a reaction portion 56 (FIG. 2) formed on the switch arm.

A blocking tab 58 is formed on switch arm 30 intermediate free end 31 and the connection point of biasing spring 42. An outer vertical surface portion 59 of tab 58 is designated as a second fulcrum.

A locking arm 60 is pivotally mounted relative to bracket end portion 18 and includes a slotted end portion 62 which is received over the end of the armature between conical portion 26 and flared end portion 28, thereby permitting sliding movement of the locking arm relative to the armature during armature movement. As shown in FIG. 3 locking lever 60 includes a straight pivot surface portion 64, also designated as a first fulcrum, which during certain phases of operation remains in contact with an end surface portion 66 of an elongated slot 68 formed in bracket end portion 18. End surface portion 66 is also designated as a fulcrum surface.

As shown by FIGS. 3 and 5, the width of the locking lever at pivot surface portion 64 is sized less than the length of slot 68 in order to permit pivotal movement of the locking lever about the second fulcrum defined by surface 59 of the blocking tab.

As shown by FIG. 3, a second biasing spring 70 has one end looped over a notch 72 formed in the end of a tab extension 74 of bracket end portion 18 and the other end thereof looped through an opening 76 formed in the locking lever at a position intermediate pivot surface portion 64 and the connection of the armature to the locking lever.

Figure 4:
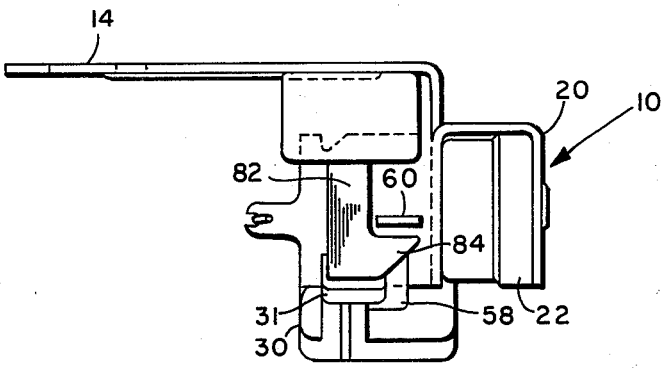
FIG. 4 is a view taken from the left side of FIG. 2 showing the lid hook locked in position by the locking lever.

As illustrated by FIGS. 2 and 4, lid latch 10 is mounted in association with a household washing machine shown partially as including a stationary machine top frame 78, and a lid 80. A latching hook 82 is connected to lid 80 and includes a lower hooked portion 84 which extends through an opening 86 in machine frame 78. As shown by FIG. 4, hooked portion 84 includes a lower horizontal abutment surface 88 which is aligned with and contacts the top surface of switch arm 30 when the lid is closed.

Prior to proper operation of the appliance, lid latch 10 is in the FIG. 3 position with the locking lever represented by the dashed lines. In this position biasing spring 70 urges the pivot surface portion 64 of the lever into contact with end surface 66 (first fulcrum) of the slot and also with a force sufficient to pull armature 24 to the position shown by the dashed lines. If lid 80 is lowered before starting the machine cycle, the latching hook 82 will depress the switch arm downwardly as shown by FIG. 2 thereby actuating microswitch 48 and allowing the spin cycle of the machine to begin. As the washing machine reaches the spin cycle, the machine timer energizes solenoid 22 resulting in inward movement of armature 24 toward the solenoid coil (solid lines of FIG. 3). Locking lever 60 is then pivoted to the FIG. 3 position, as shown by the solid lines, in which the lever is positioned over hooked portion 84, thereby preventing opening of the lid. By limiting the size of opening 86 and positioning the locking lever closely adjacent the lower side of the frame 78 a suitably rigid latch is achieved due to the relatively short span across which the locking lever resists bending.

If, however, lid 80 remains open and the washing machine is started, the switch arm 30 will not be depressed when the timer energizes solenoid 22. In this condition, when energized, armature 24 will pivot the locking lever to the position as shown by FIG. 5 in which the locking lever reacts and has pivoted against blocking tab 58 on the switch arm. The clearance between slot 68 and the width of the locking arm allows the armature to overcome the force of biasing spring 70 and move the lever out of contact with end surface portion 66. Armature 24 then registers against the end pole frame of the solenoid (not shown), thus preventing overheating of the solenoid coil. A further feature of the invention is that the locking lever is prevented from being positioned in the path of motion of the latching hook which would result in the locking lever being bent downwardly when the lid is closed, thereby damaging and disabling the lever.

In the present invention, if the lid is closed after the washing machine spin cycle has started, the locking lever will be held to the side by abutment tab 58. Subsequent closing of the lid permits the latching hook to contact and move the switch arm downwardly. If the solenoid had been previously energized, the lowering of blocking tab allows the locking lever to be snapped into the FIG. 3 position by biasing spring 70.

The embodiment of the invention as shown and described above is representative of the inventive principles stated therein. It is to be understood that variations and departures can be made from the embodiment as shown without, however, departing from the scope of the appended claims.

What is claimed is:

1. An electro-mechanical latch assembly for a washing machine, said washing machine having a drum access lid and a latching hook connected to said lid, said latch comprising:

(a) a mounting bracket adapted for connection to the machine, said bracket including means defining a first fulcrum;

(b) electrical switch means mounted on said bracket;

(c) a switch lever pivotally mounted to said bracket and movable between a first and second position, said switch lever including, (i) a free end portion adapted for contact by said latching hook, (ii) surface means engageable with said switch means to actuate said switch means between open and closed positions;

(d) means for biasing said switch lever to said first position;

(e) electrically operable solenoid means mounted on said bracket, said solenoid means including an armature movable between a first extended position and a second retracted position upon energization of said solenoid means;

(f) a locking lever pivotally mounted on said bracket means, said locking lever engageable with said first fulcrum, said locking lever having a first portion thereof operably connected to said armature and another portion thereof engageable with said hook, said locking lever movable between a first position in which said hook end is spaced from said switch lever, a second position spaced from said switch lever and said first fulcrum, and a third position spaced closely adjacent said switch lever and in the path of movement of said lid hook;

(g) means for biasing said locking lever against said fulcrum surface means; and (h) said switch lever further including means defining a second fulcrum located adjacent said first portion and operable to prevent movement of said locking lever to said third position, said second fulcrum causing said locking lever to pivot thereabout when said switch lever is in said first position and said solenoid means is energized, thereby preventing said locking lever from aligning in the path of movement of said lid hook.

2. The device as defined in claim 1, wherein said first fulcrum defining means includes surface portions of an elongated slot, said slot having a length exceeding the cross-sectional width of said locking lever, such that said locking lever is movable away from said first fulcrum surface means and said locking lever pivots about said second fulcrum surface means.

3. The device as defined in claim 1, wherein said means for biasing said locking lever comprises a spring connected at one end thereof to said locking lever at a point intermediate said armature connection and said fulcrum surface.

4. The device as defined in claim 1, wherein said means defining a second fulcrum surface includes a blocking tab operative to prevent said locking lever free end from aligning closely adjacent said switch arm as said switch arm is in said first position and said solenoid is energized such that said latching hook is movable downwardly past said locking lever, said switch arm movable downwardly to said second position, whereupon the blocking tab is moved out of engagement with said locking lever.

5. The device as defined in claim 1, wherein said switch lever is movable in a substantially vertical plane and said locking lever is movable in a substantially horizontal plane.

6. A latch assembly for a washing machine drum access door of the type having a latching member attached thereto, said assembly comprising:

(a) mounting bracket means including structure defining a first fulcrum;

(b) actuator means energizable upon receipt of a control signal mounted on said bracket means, said actuator means including a control member movable between a first and second position in response to energization of said actuator means;

(c) an output arm member pivotally mounted on said bracket means and movable between a first and second position, said arm having a first portion adapted to contact a spin cycle switch on the washing machine, said arm having a second portion adapted to contact the lid latch, and a third portion defining a second fulcrum; and, (d) locking means including a locking member pivoted about said first fulcrum, said locking member being operatively connected for movement by movement of said control member wherein upon movement of said control member from the first position to the second position, said locking member pivots about said first fulcrum when said output arm is in said first position and is engageable with said latching member, and when said output arm is in said second position, said locking member pivots about said second fulcrum and is prevented from moving to a position in the path of said latching member so as to prevent engagement therewith.

7. The device as defined in claim 6, wherein said first fulcrum is defined by surface portions of an elongated slot, said slot having a length exceeding the cross-sectional width of said locking member, such that said locking member is movable away from said first fulcrum and said locking member pivots about said second fulcrum.

8. The device as defined in claim 6, further including means for biasing said locking member into engagement with said first fulcrum, said biasing means comprises a spring connected at one end thereof to said locking member at a point intermediate said control member connection and said first fulcrum.

9. The device as defined in claim 6, wherein said second fulcrum includes a blocking tab operative to prevent said locking member from aligning closely adjacent said output arm member as said output arm member is in said first position and said solenoid is energized such that said latching hook is movable downwardly past said locking member, said output arm member movable downwardly to said second position, whereupon said blocking tab is moved out of engagement with said locking member.

10. The device as defined in claim 6, wherein said output arm lever is movable in a substantially vertical plane and said locking member is movable in a substantially horizontal plane.

* * * * *